US008096160B2

(12) United States Patent
Åkesson

(10) Patent No.: US 8,096,160 B2
(45) Date of Patent: Jan. 17, 2012

(54) METHOD FOR REDUCING SHEARING AND CROP LOSSES AT ROLLING OF ASSEMBLED SLABS

(75) Inventor: Conny Åkesson, Ljusfallshammar (SE)

(73) Assignee: SAPA Heat Transfer AB, Finspång (SE)

( * ) Notice: Subject to any disclaimer, the term of this patent is extended or adjusted under 35 U.S.C. 154(b) by 516 days.

(21) Appl. No.: 11/606,885

(22) Filed: Dec. 1, 2006

(65) Prior Publication Data

US 2007/0144229 A1 Jun. 28, 2007

(30) Foreign Application Priority Data

Dec. 1, 2005 (SE) ..... 0502633

(51) Int. Cl.

| | |
|---|---|
| ***B21B 1/00*** | (2006.01) |
| ***B21B 15/00*** | (2006.01) |
| ***B21B 31/20*** | (2006.01) |
| ***B21B 23/00*** | (2006.01) |
| ***B21D 31/00*** | (2006.01) |

(52) U.S. Cl. ..... 72/203; 72/206; 72/240; 72/363; 72/365.2

(58) Field of Classification Search ..... 72/200–252.5, 72/363, 199, 365.2

See application file for complete search history.

(56) References Cited

U.S. PATENT DOCUMENTS

| | | | | |
|---|---|---|---|---|
| 3,858,428 | A * | 1/1975 | Thompson | 72/363 |
| 4,238,946 | A | 12/1980 | Tsubota | |
| 4,486,509 | A * | 12/1984 | Deschapelles et al. | 428/582 |
| 6,329,075 | B1 * | 12/2001 | Nener et al. | 428/654 |
| 6,453,712 | B1 * | 9/2002 | Klosterman et al. | 72/199 |

FOREIGN PATENT DOCUMENTS

| | | | |
|---|---|---|---|
| JP | 59 027701 | A | 2/1984 |
| JP | 59 178105 | A | 10/1984 |
| JP | 60-255202 | * | 12/1985 |
| JP | 61-262456 | A | 11/1986 |
| JP | 61 262456 | A | 11/1986 |
| JP | 62212003 | A | 9/1987 |
| JP | 2030741 | A | 2/1990 |
| JP | 2005297016 | A | 10/2005 |
| WO | WO 01/56782 | A2 | 8/2001 |
| WO | WO 01/94050 | A2 | 8/2001 |

OTHER PUBLICATIONS

European Search Report.
Notice of Reason for Refusal (Office Action) Issued March 1, 2011, in couterpart Japanese patent application 2006-323753.

* cited by examiner

*Primary Examiner* — Edward Tolan
*Assistant Examiner* — Mohammad Ibrahim Yusuf
(74) *Attorney, Agent, or Firm* — Venable LLP; Eric J. Franklin

(57) ABSTRACT

A method for increasing slab rolling yields and rolling mill efficiency by minimizing shearing and crop losses in the rolling of assembled slabs. An assembled structure for aluminium rolled products includes a core slab with a reduced cross-section in the thickness direction of the slab in at least one of the slab edges running parallel to the rolling direction. At least one second slab is assembled to the core slab. The edges of the slab may have a cut-out and/or a tapered shape. A method of reducing shearing and crop losses at the rolling of assembled slabs, by using a core slab with a reduced cross-section in the thickness direction of the slab in at least one of the slab edges running parallel to the rolling direction.

17 Claims, 4 Drawing Sheets

METHOD FOR REDUCING SHEARING AND CROP LOSSES AT ROLLING OF ASSEMBLED SLABS

CROSS-REFERENCE TO RELATED APPLICATIONS

This application claims priority under 35 U.S.C. §119 to Swedish patent application 0502633-1 filed 1 Dec. 2005.

BACKGROUND OF THE INVENTION

The present invention relates to the rolling of assembled metal slabs and, more particularly, to methods for increasing slab rolling yields and rolling mill efficiency by minimizing shearing and crop losses in the rolling of assembled slabs. This favourable increase in material yield and rolling efficiency is achieved by a new slab geometry formed in one or both edges of the slab. The slab geometry is formed by machining or during casting. The invention is most advantageously applied to the manufacture of aluminium rolled products.

A widely used method of manufacturing aluminium plate, sheet and foil products initially involves the vertical semi-continuous casting of slabs which includes a bottommost leading end, referred to in the art as the "butt" of the slab. The butt is formed as the liquid metal solidifies on the movable bottom block or starter block which is in the open bottom of the mould. The bottom block continuously moves downwardly and away from the mould as the solidified metal slab exits at the open end of the mould at the location previously occupied by the bottom block. The sidewalls of the mould and the sidewalls of the solidified slab exiting the mould are sprayed with water to increase the solidification rate. This casting technique is referred to as direct chill or "DC" casting.

The slabs may then be scalped to remove as-cast surface imperfections and further homogenized by heating in a furnace to provide a uniform chemistry across the slab cross-section prior to laminating with a second or further slab. The second slab is commonly of an aluminium alloy of different composition welded to the core, often a braze material or a cladding aimed at improving the corrosion behaviour.

In order to process the thus treated slabs to useful end products, such as sheet, plate, foil or the like, the slabs are preferably welded together at the edges and thereafter heated to a desired rolling temperature and subjected to a plurality of hot rolling passes in a hot rolling mill to laminate the slabs, followed by cold rolling, whereby a clad materials results. The core slab may be assembled to several further slabs, located on either side of the slab core or on the same side, and often made from a softer metal than the core, such as a braze material with a high silicon content. The slabs forming the clad may also be made from aluminium alloys aimed at improving the corrosion resistance of the rolled strip.

The resulting material is useful as a heat exchanger strip or plates, e g as a fin or tube material as well as for evaporator and header plates.

The free surfaces existing on a slab of finite width, thickness and length allow non-uniform rolling deformation to occur in the length and width dimensions during hot rolling. This non-uniform deformation causes an elongation of the slab in the centre region thereof which forms a convex, longitudinally extending "tongue" condition at the edges thereof, particularly in aluminium slabs which are roughed down in reversing mills, usually without the use of side or edge rolls. Formation of a tongue condition is, however, not uncommon in the rolling of aluminium even in mills equipped with edge rolls. When rolling a clad material, such as a slab for heat exchanger strip, the clad is often softer than the core, thus deforming more easily, making the problem of non-uniform deformation more severe. The force acting on the slabs will be higher at the edges running parallel to the rolling direction, due to the elastic deformation of the rolls. This leads to the formation of an uneven clad close to the edges of the slab and to an increased shearing loss.

In JP59027701 the edges of the side faces of a steel slab has continuous corrugations in order to minimize flaws and reduce margins for trimming. This measure has not shown to be efficient for clad slabs.

The aforesaid non-uniform deformation phenomenon is equally severe in the length direction of the slab leading to another condition referred to in the art as "fold over", "overlap" or "alligatoring". These objectionable conditions at the ends of the slab grow worse as rolling continues and must eventually be removed by a crop shear to permit further rolling to continue.

It is (also) well-known that the overlap causes an internal lamination crevice in the metal which grows during rolling and will result in unsound plate and sheet products unless it is removed by shearing.

The use of a clad material also makes recycling of the scrap more difficult, due to the mixed composition in the assembled material.

Previous experimental work has been undertaken JP61262456 in an effort to reduce slab rolling shearing and crop losses by tapering the ends of the slab by deforming the edges of a slab by issuing inclined rolls to increase the yield at rolling. The clad is cast onto the deformed core to create a thicker clad at the edges of the slab, thereby assuring a thick enough cladding also at the edges. The problem with unevenness of the cladding will however remain.

WO01/94050 discloses an aluminium slab with a reduced cross-section in the ends of the slab to reduce crop losses. The problem of uneven clad deformation during rolling is not assessed.

SUMMARY OF THE INVENTION

The present invention overcomes the shortcomings of the prior art by providing a method and a slab of specific geometry for reducing hot mill crop and shearing losses at the edges of a assembled structure for aluminium rolled products which greatly improves mill productivity and metal yield, particularly in the hot rolling of aluminium products.

The present invention discloses a method and a product which provide a core slab having a special configuration formed at longitudinal edges running parallel to the rolling direction of the slab. The specially configured slab provided by the present invention minimizes the occurrence of an uneven clad thickness during slab rolling, thus reducing the shearing and crop losses to increase mill productivity and metal recovery.

1. The present invention provides an assembled structure arranged for a rolling process comprising:

- a core slab having:
  - first and second ends and there between longitudinal edges running parallel to the rolling direction and
- a reduced cross-section in the thickness direction of the core slab in at least one of the longitudinal edges, and
- at least one second slab arranged in a parallel relationship with the core slab.

Secondly, the present invention also provides a method of producing an aluminium strip from the assembled structure by hot rolling and cold rolling the slab to a suitable gauge as well as the strip so produced.

Thirdly, the present invention provides a method of reducing shearing and crop losses at the rolling of slabs, by (a) providing a core slab with a reduced cross-section in the thickness direction of the slab in at least one of the slab edges
(b) providing at least one second slab
(c) optionally scalping the slabs
(d) assembling the slabs
(e) conducting a plurality of rolling passes on said slabs to laminate said slabs and to reduce the thickness thereof and elongate said slab, whereby a metal strip with an even clad thickness is obtained.

The strip may be used in heat exchanger applications.

The reduction of the cross-sectional area is preferably made by machining, but other methods, such as the formation of the special shape during casting of the slab, is not excluded.

BRIEF DESCRIPTION OF THE DRAWINGS

The invention will now be described in more detail, references below being made to the accompanying drawings wherein FIG. 1 (*a*) is a cross-section of an edge of a clad slab perpendicular to the rolling direction after some rolling passes according to the state of the art.

DETAILED DESCRIPTION OF EMBODIMENTS OF THE INVENTION

Figure 1A:
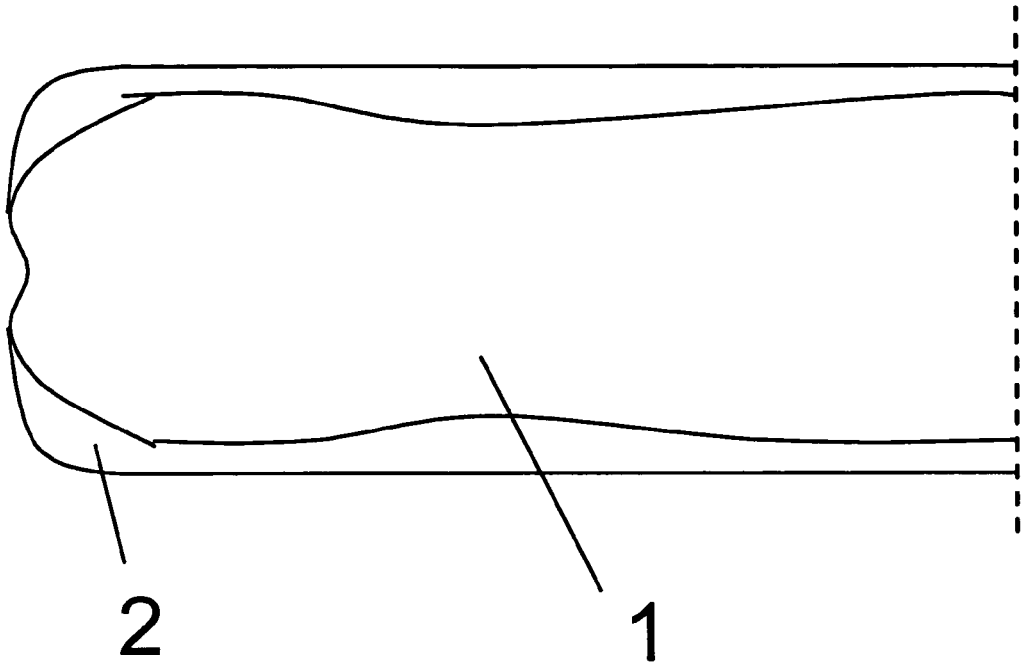
FIG. 1 (*b*) a cross-section of an edge of clad slab perpendicular to the rolling direction after some rolling passes according to the invention.
Figure 1B:
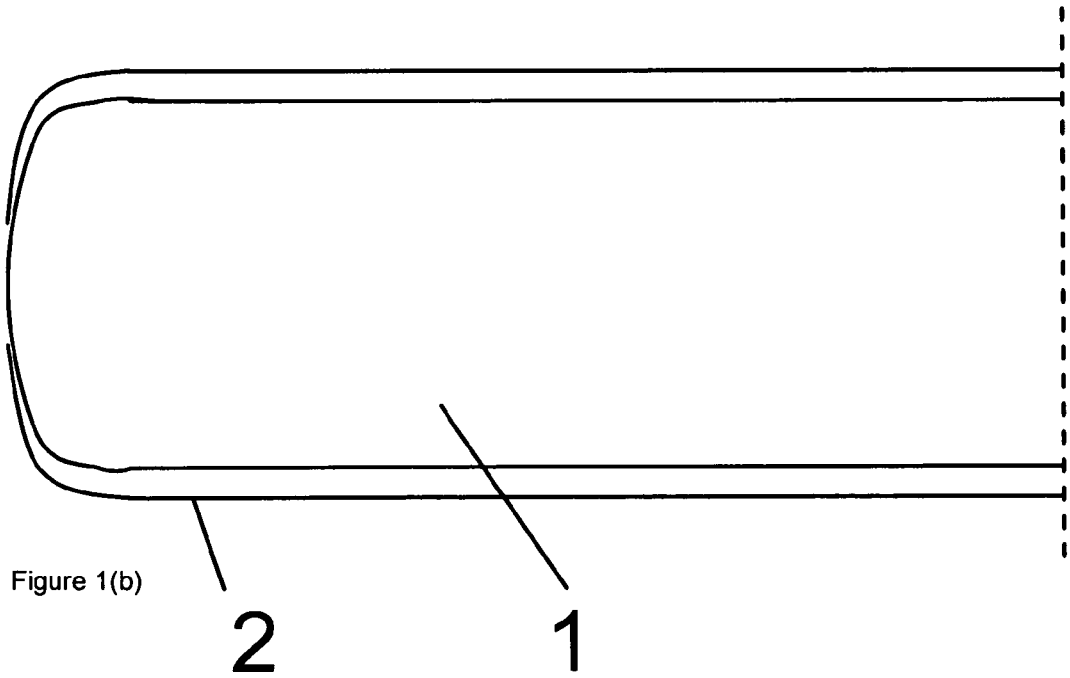

FIG. 1 (*a*) demonstrates the problem that occurs when rolling a clad slab of conventional shape. The edges assume a tongue-shape when the material in the centre of the core (1) is pushed out while the surface material flow is restricted by the friction forces applied by the rolls. When the core is clad, the clad (2) will, due to it being softer than the core, deform more easily, thereby experiencing "over-run" of the clad around the edges. At the edges of the slab the clad/core ratio gets non-uniform, resulting in loss of material as the edges have to be trimmed.

Figure 2:
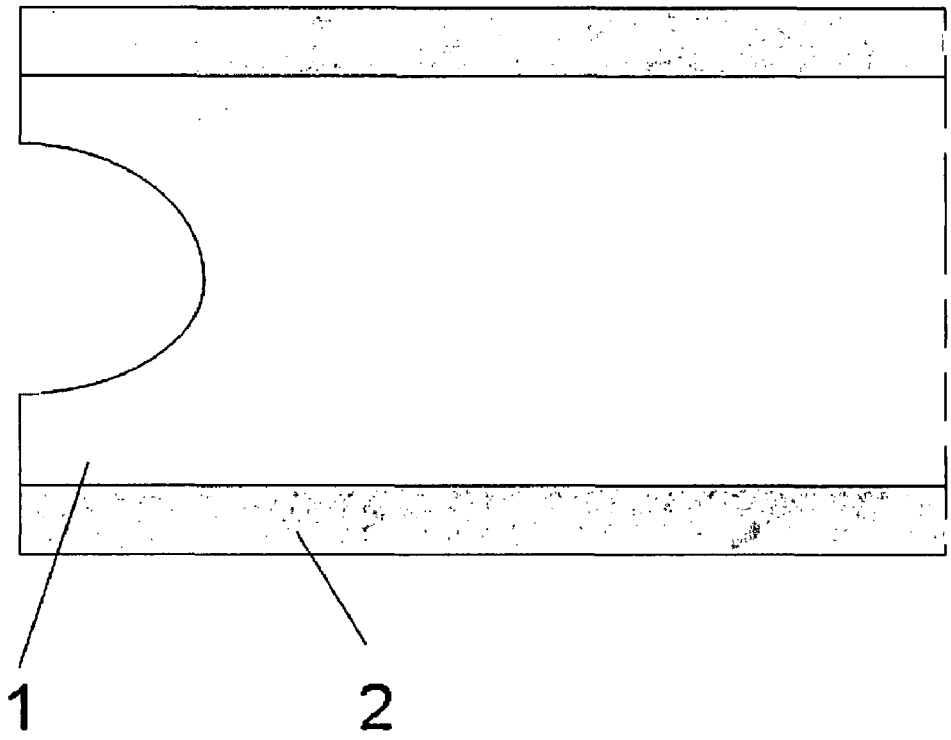
FIG. 2 shows a cross section of an edge of a clad slab perpendicular to the rolling direction before rolling. The slab has a modified shape according to one embodiment of the invention.

When a cut-out is machined in the slab edge according to FIG. 2 the slab deforms in a way that minimizes the formation of an uneven clad (see FIG. 1 (*b*)) and thus reduces the amount of scrap accordingly. The cut out can have any shape, but is preferably in the shape of a U, a V or a polygon. The cut-out may be located in the centre of the slab, or may be displaced from the centre of the slab in the thickness direction, that is in the direction perpendicular to the plane of the slab, so that the deformation resistance of the core is adjusted to the hardness of the core slab in relation to the hardness of the second slab. The deformation of the second slab will then be more uniform.

It is preferable that the cut-out extends across at least a third of the slab thickness, more preferably at least half the thickness of the slab. In accordance to this said cross section of the core slab will be reduced by at least one third or by at least half, respectively. The cut-out or tapered shape of the edges may be combined with tapered slab ends so that the core has a reduced cross-section in the thickness direction of the core slab in at least one of the slab ends perpendicular to the rolling direction. For attachment, e g by welding, of the second or third slab to the core slab a cut-out is however preferred.

The depth of the cut-out into the core edge should preferably be greater than the width in the thickness direction. Most preferably the depth should be at least 1.5 times the width in the thickness direction.

Figure 3:
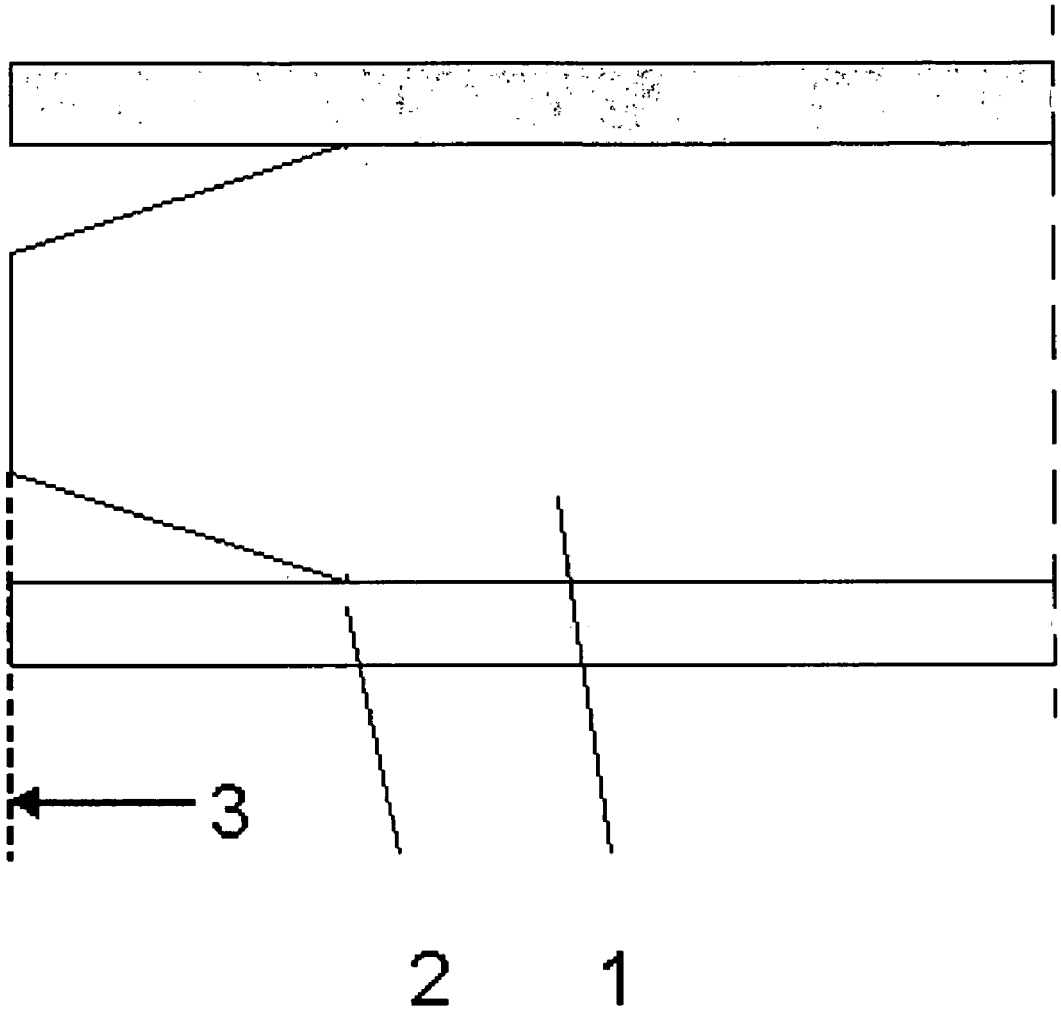
FIG. 3 shows a cross-section of an edge of a clad slab before rolling. The slab has a modified shape according to one embodiment of the invention.

The edges of the slab may alternatively, or in combination with the cut-out, have a tapered shape according to FIG. 3. This modified shape also reduces the problem with uneven clad thickness and consequently the amount of scrap. The second or third slab should extend to the edge (3) of the core slab, in order to provide material for cladding the core slab as the core deforms during rolling. This configuration keeps the slab from slipping against the rolls, thus providing a more even core/clad thickness ratio.

Figure 4:
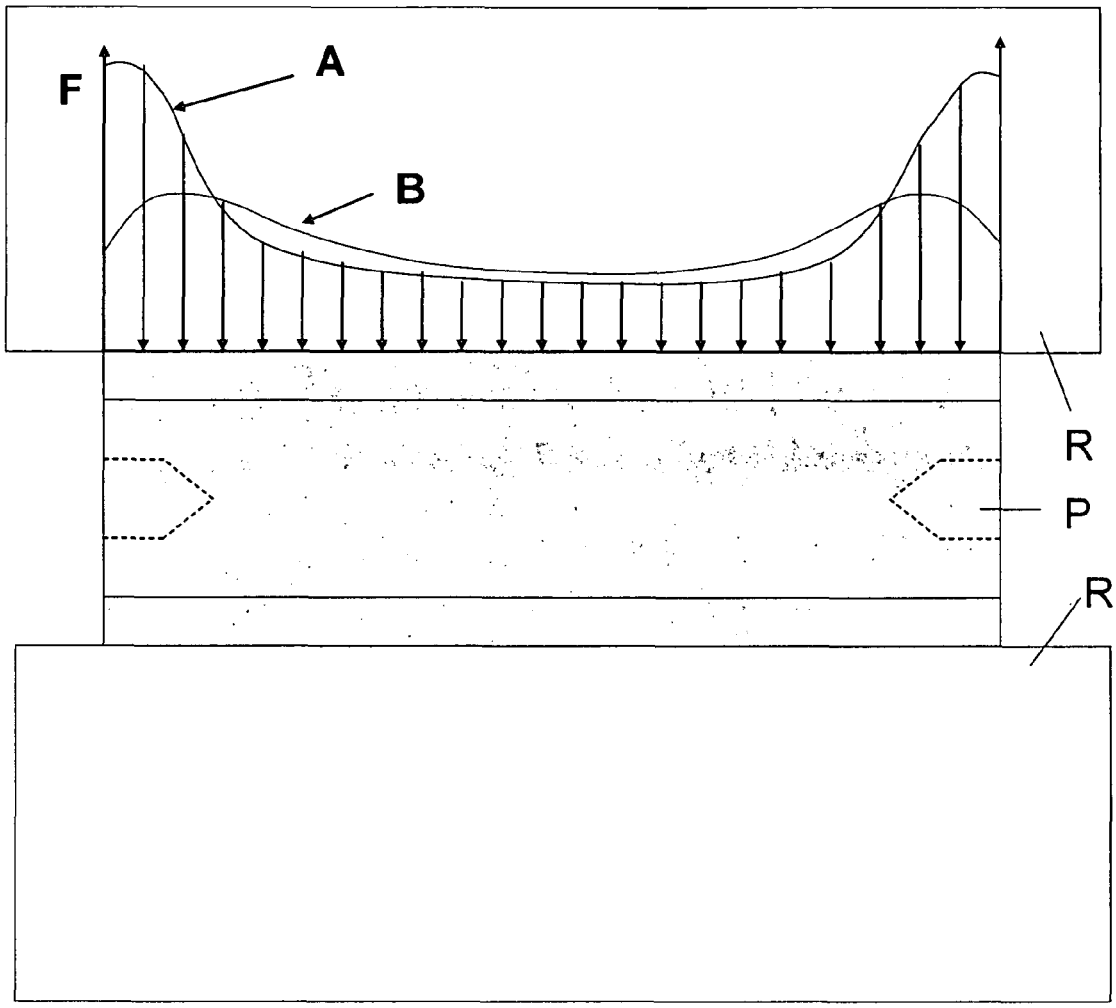
FIG. 4 shows the pressure exerted by the rolls on a slab, with and without a cut-out in the edge centre.

In FIG. 4 the force exerted by the rolls "R' on an assembled structure according to the invention is shown, curve A showing the force for slabs according to the prior art and curve B showing the force for slabs having a cut-out in the shape of a polygon (P). As can be seen the variation of the force exerted is much smaller in curve B, due to a smaller elastic deformation of the rolls when the core cross-section is reduced. The resulting clad is thereby more even in thickness over the width of the strip and the loss at trimming of the edges smaller.

The reduction in thickness may be any of the mentioned cut-out or surface tapers, used singly or in combination. The reduction of the core cross-section reduces the deformation resistance of the core at the edges (and ends, if used), and thereby the deformation of the clad at the clad edges (and ends) is reduced, leading to a more uniform clad thickness.

The material of the core slab and the clad may be any metal, but is mainly directed to aluminium alloys.

The rolled strip may be used as heat exchanger strip and plate for e.g. fins, tubes or header plates, evaporator plates. The invention solves the problem of reducing shearing and crop loss by controlling the material flow as described above in order to improve the yield of aluminium production in rolling.

EXAMPLE

An aluminium alloy core slab was cast with the DC method and scalped to remove as-cast surface imperfections. A cut-out of polygon-shape (P) was machined in the edges of the slab according to FIG. 4 and the surfaces of the slab ends were machined to a taper shape according to FIG. 3. A second slab (scalped) of rectangular shape consisting of an aluminium braze alloy was welded to the core slab at the edges thereof. The slabs were hot rolled and cold rolled to the finished dimension. A piece of the resulting strip was cut off and hot mounted in resin and polished, and the cross-section of the strip was examined in an optical microscope. The variation in clad thickness over the strip width was less than 2% and the end part with defects was very small. The resulting strip was coiled and slit into strips and delivered to a heat exchanger manufacturer for further processing.

I claim:

1. A method of producing a clad strip by rolling, the method comprising:

providing a core slab having a first end and a second end and longitudinal edges running between the first end and the second end parallel to a rolling direction of the core slab, providing at least one second slab arranged in a parallel relationship with the core slab, optionally scalping the slabs, assembling the core slab and the at least one second slab to form an assembled structure, and hot rolling and cold rolling the assembled structure in said rolling direction until the assembled structure reaches a suitable gauge so as to produce the clad strip, wherein the core slab has reduced cross-section in a thickness direction of the core slab in at least one of the longitudinal edges of the core slab.

2. The method according to claim 1, wherein said reduced cross section in the thickness direction of the core slab is provided by at least one cut-out at the longitudinal edges of the core slab.

3. The method according to claim 1, wherein said reduced cross section in the thickness direction of the core slab is provided by at least one cut-out being displaced from a center of the core slab in the thickness direction of the core slab.

4. The method according to claim 1, wherein said reduced cross section in the thickness direction of the core slab is provided by a taper of an upper and/or a lower surface of the core slab in a direction of the longitudinal edges of the core slab.

5. The method according to claim 1, wherein a total reduction of the cross section in the thickness direction of the core slab is at least one third of a thickness of the core slab.

6. The method according to claim 1, wherein a total reduction of the cross section in the thickness direction of the core slab is at least half of a thickness of the core slab.

7. The method according to claim 2, wherein a depth of the at least one cut-out into the longitudinal edges of the core slab is greater than a width of the at least one cut-out in the thickness direction of the core slab.

8. The method according to claim 1, wherein the at least one second slab extends to the longitudinal edges of the core slab.

9. The method according to claim 1, wherein the core slab comprises an aluminum alloy.

10. The method according to claim 9, wherein the at least one second slab comprises a softer metal than the core slab.

11. The method according to claim 9, wherein the at least one second slab comprises an aluminum alloy different from the core slab alloy.

12. The method according to claim 1, wherein the at least one second slab comprises a braze alloy.

13. The method according to claim 1, wherein the at least one second slab has a rectangular cross-section.

14. The method according to claim 1, wherein the core slab has a reduced cross-section in the thickness direction of the core slab in at least one of the slab ends perpendicular to the rolling direction.

15. The method according to claim 1, wherein the core slab having a reduced cross section in a thickness direction of the core slab in at least one of the longitudinal edges of the core slab is provided by casting.

16. The method according to claim 1, wherein the core slab having a reduced cross section in a thickness direction of the core slab in at least one of the longitudinal edges of the core slab is provided by machining.

17. The method according to claim 3, wherein a depth of the at least one cut-out into the longitudinal edges of the core slab is greater than a width of the at least one cut-out in the thickness direction of the core slab.

* * * * *